US007788887B2

(12) United States Patent
Baenninger

(10) Patent No.: US 7,788,887 B2
(45) Date of Patent: Sep. 7, 2010

(54) DEVICE FOR FILLING A CONTAINER

(75) Inventor: Michel Baenninger, Bretigny-sur-Morrens (CH)

(73) Assignee: Bobst S.A. (CH)

( * ) Notice: Subject to any disclaimer, the term of this patent is extended or adjusted under 35 U.S.C. 154(b) by 151 days.

(21) Appl. No.: 12/281,072

(22) PCT Filed: Feb. 27, 2007

(86) PCT No.: PCT/EP2007/001664

§ 371 (c)(1),
(2), (4) Date: Aug. 28, 2008

(87) PCT Pub. No.: WO2007/098915

PCT Pub. Date: Sep. 7, 2007

(65) Prior Publication Data

US 2009/0064639 A1 Mar. 12, 2009

(30) Foreign Application Priority Data

Feb. 28, 2006 (EP) ..... 06004046

(51) Int. Cl.
*B65B 5/08* (2006.01)
*B65B 5/10* (2006.01)
*B65H 39/10* (2006.01)

(52) U.S. Cl. ..... 53/542; 53/244; 53/259; 198/369.2; 271/200; 271/214; 271/302

(58) Field of Classification Search ..... 53/542, 53/244, 259; 198/369.2; 271/200, 214, 302
See application file for complete search history.

(56) References Cited

U.S. PATENT DOCUMENTS 2,795,312 A * 6/1957 Howdle ..... 198/369.2
3,292,340 A 12/1966 Smith, Jr. et al.
3,593,624 A * 7/1971 Dufour ..... 414/788.3
3,904,019 A * 9/1975 Carlen et al. ..... 271/302
4,015,840 A * 4/1977 Schroder ..... 271/302
4,161,092 A 7/1979 Buday et al.
4,656,815 A 4/1987 Jaton
4,835,947 A * 6/1989 Langen et al. ..... 53/542
5,467,976 A * 11/1995 Doucet ..... 271/302
5,647,589 A 7/1997 Kurandt et al.
6,082,733 A * 7/2000 Borel ..... 271/200
6,644,651 B2 * 11/2003 Allsup ..... 271/302
2004/0098948 A1 * 5/2004 Caporali et al. ..... 53/542
2004/0187447 A1 9/2004 Byrd, Jr. et al.

FOREIGN PATENT DOCUMENTS

CH 659627 2/1987
JP 01252457 A * 10/1989

OTHER PUBLICATIONS

International Search Report dated Apr. 16, 2007, issued in corresponding PCT Application No. PCT/EP2007/001664.

* cited by examiner

*Primary Examiner*—Stephen F Gerrity
(74) *Attorney, Agent, or Firm*—Ostrolenk Faber LLP

(57) ABSTRACT

A filling device including a web-forming station (A), a filling station (B), a sampling station (C), and a retrieval station (D). A first box conveyor (3) for conveying boxes exiting a folder-gluer (1) and for forwarding them from the web-forming station (A) to the filling station (B) along a forwarding path (Ta). A second box conveyor (10) for conveying boxes forwarded by the first box conveyor (3) and for transferring them from the sampling station (C) to the retrieval station (D) along a transfer path (Tt).

8 Claims, 3 Drawing Sheets

DEVICE FOR FILLING A CONTAINER

CROSS REFERENCE TO RELATED APPLICATION

The present application is a 35 U.S.C. §§371 national phase conversion of PCT/EP2007/001664, filed 27 Feb. 2007, which claims priority of European Application No. 06004046.6, filed 28 Feb. 2006. The PCT International Application was published in the French language.

TECHNICAL FIELD

The present invention relates to a device for filling a container, with folding boxes, of the type comprising a stream feeder, a filling station, a box conveyor for conveying the boxes exiting a folder-gluer and for forwarding them from the stream feeder to the filling station along a forwarding path.

PRIOR ART

CH 659627 A describes a filling device of the abovementioned type. Such a device is provided for filling containers with folding boxes automatically and safely while ensuring that the operator can oversee all the operations carried out from shingling to filling. However, if the operator periodically has to prepare samples of the folding boxes for production quality control purposes, in particular to meet the requirements of the ISO 9000 standards, he has to retrieve the samples either upstream of the filling device, before the boxes are processed by the filling device, i.e. at the exit of the folder-gluer, or downstream of the filling device, i.e. after the boxes have been processed by the filling device.

Automatic sampling devices upstream of the filling device are known which prevent the operator from manually taking samples of folding boxes at the exit of a folder-gluer. See, for example, DE 19502676 A. However, this known type of sampling device has, in addition to a certain technical complexity, the drawback that only one box can be taken at a time, so that each sample consists of a single box.

Downstream of the filling device, the operator himself has to take samples of the folding boxes from the containers. This is not compatible with the high-speed production systems used in the packaging industry. In fact, a folder-gluer of the type capable of supplying a filling device of the abovementioned type is capable of producing up to 200 000 boxes per hour.

DISCLOSURE OF THE INVENTION

It is an object of the invention to remedy the abovementioned drawbacks by providing a filling device that avoids taking samples of folding boxes both upstream and downstream of the filling device.

For this purpose, the invention is a device for filling a container with folding boxes.

As will be seen from the following description, the solution provided is particularly simple, both from the point of view of manufacturing and of using the device.

Further particular features and advantages of the present invention will emerge from the following description given with the aid of the attached drawings which illustrate schematically and by way of example an embodiment of the filling device which is the subject of the present invention.

PREFERRED EMBODIMENT OF THE INVENTION

Figure 1:
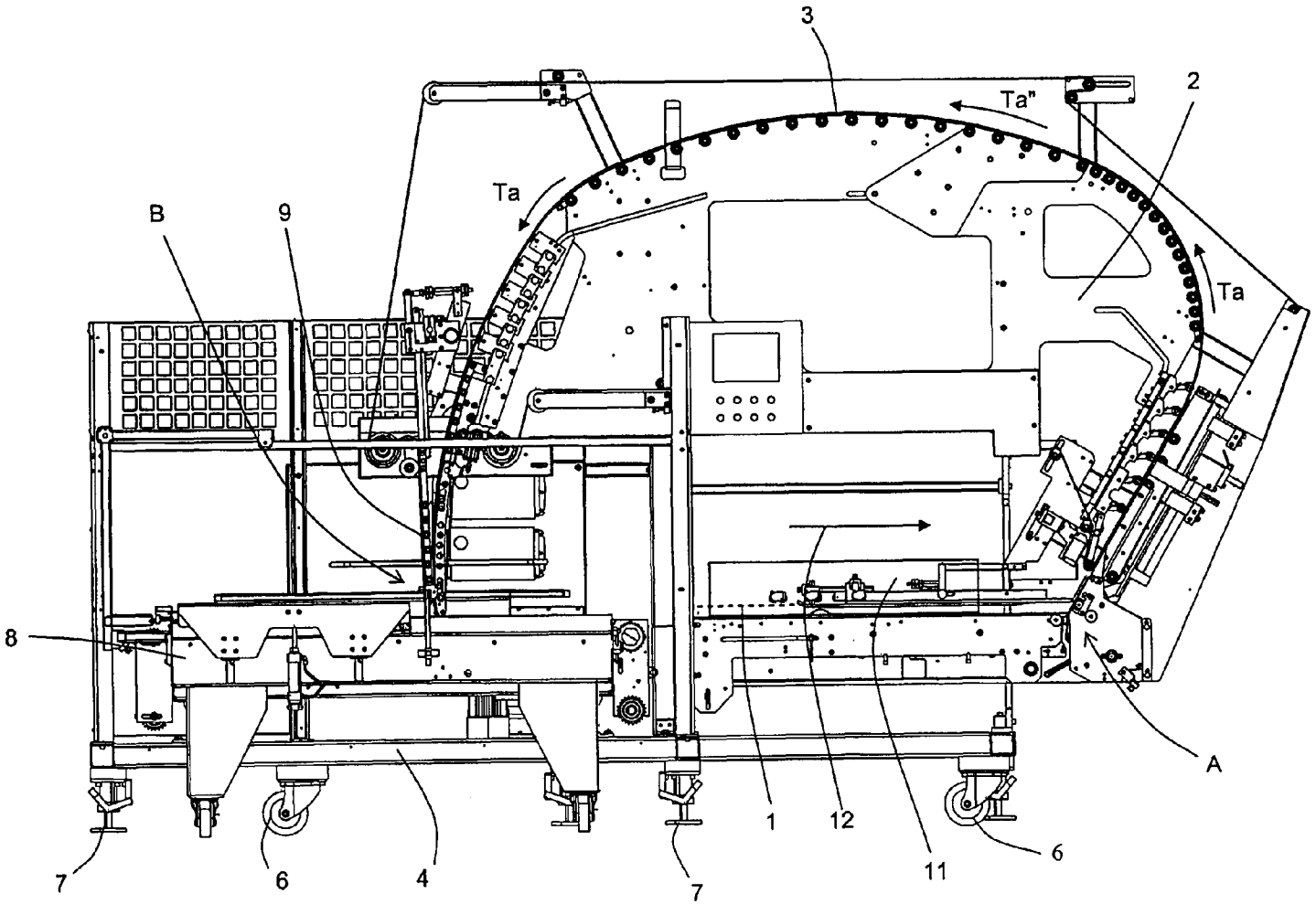
FIG. 1 PRIOR ART
FIG. 1 is a general front view of a filling device according to the prior art.

FIG. 1 is a general front view of a filling device according to the prior art placed at the exit of a folder-gluer 1.

The filling device comprises a frame 2 comprised of a vertical support plate on which a belt conveyor 3 is fitted for forwarding folding boxes (not shown) from a stream feeder A to a filling station B along a forwarding path Ta. At least part Ta" of path Ta is located above the horizontal plane passing through the median axis of the folder-gluer 1 (shown in dashed line). The frame 2 is fitted on a base 4 supporting a belt conveyor 5 perpendicular to the median axis of the folder-gluer 1. The filling station B is also fitted on the base 4. The belt conveyor 5 is driven by an electric motor which allows the supply rate of the filling device to be controlled as a function of the speed of the last roll of the delivery station of the folder-gluer 1, thus facilitating the connection between the folder-gluer and the filling device. The base 4 is provided with casters 6 and brakes 7 permitting the filling device to be positioned at the exit of the folder-gluer 1.

The folding boxes exit the folder-gluer 1 as a shingle and arrive at an abutment 11 of the filling device that is intended to hold them, such that the belt conveyor 5 driven in the direction of the arrow 12 conveys them as a as a stream into the stream feeder A. The abutment 11 is for example a plate made of a transparent plastic. The folding boxes are then forwarded by the box conveyor 3 to the filling station B where a container (not shown) is waiting to be filled by a filling arm 9. The container is then moved onto a table 8, from where it can be removed.

Figure 2:
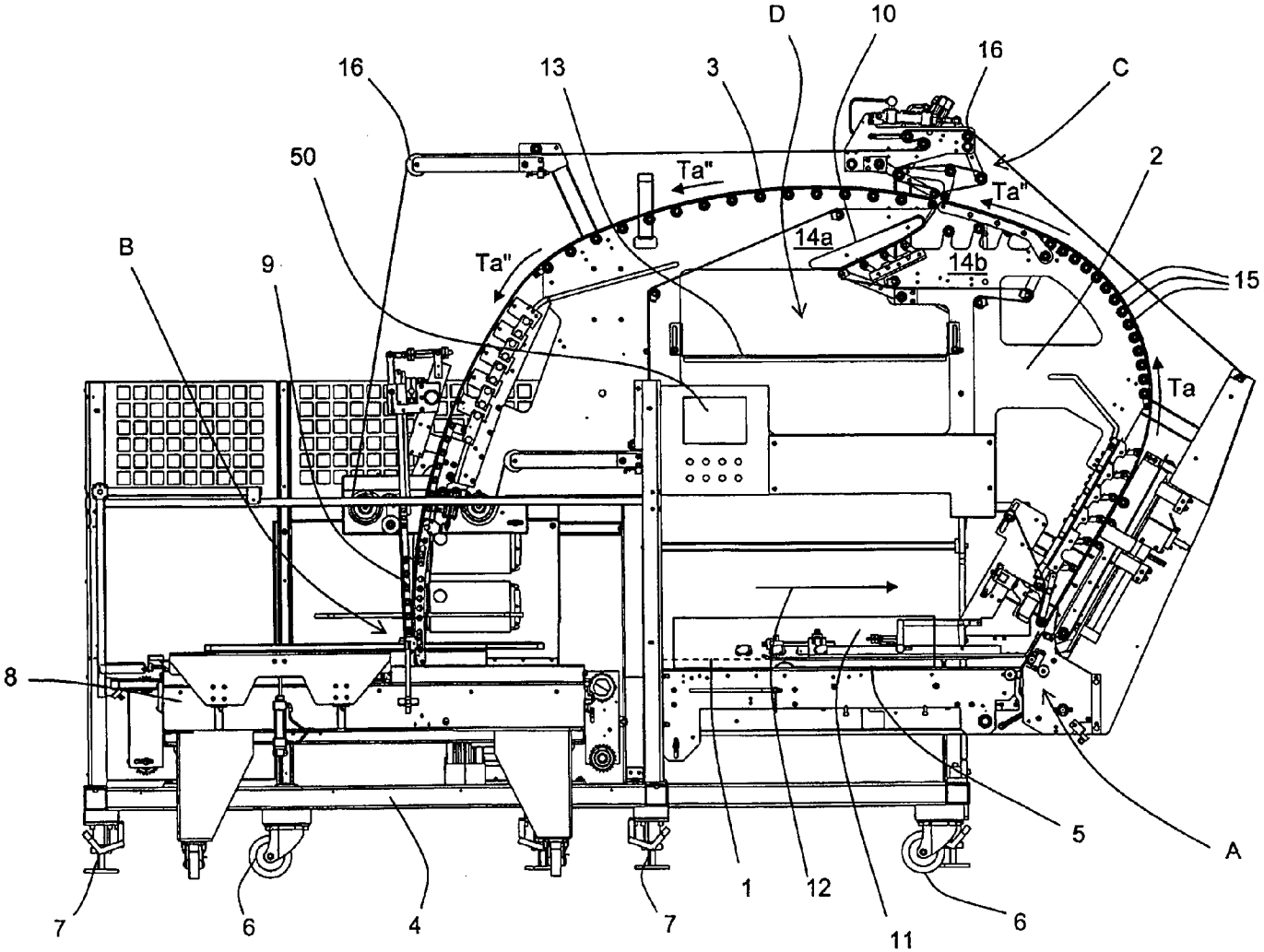
FIG. 2 is a general front view of a filling device according to the invention.

The filling device according to the invention and illustrated in FIG. 2 differs from the filling device of the prior art in that it comprises a sampling station C, a retrieval station D, a second box conveyor 10 for conveying the boxes forwarded by the first box conveyor 3 and for transferring them from the sampling station C to the retrieval station D along a transfer path Tt. A more detailed description of the sampling station C will be given in relation to FIGS. 3 and 4. The retrieval station D is arranged below the sampling station C and comprises a shelf 13 fitted across an opening in the frame 2 and able to hold a tray (not shown) in order to retrieve the samples of folding boxes. The second box conveyor 10 is also a belt conveyor arranged between the sampling station C and the retrieval station D so as to be able to retrieve the sampled boxes, i.e. the boxes deflected by the sampling station C, and transfer them to the retrieval tray along an approximately rectilinear transfer path Tt. The first box conveyor 3 and the second box conveyor 10 are fitted on two parts 14*a*, 14*b* of the frame 2.

Figure 3:
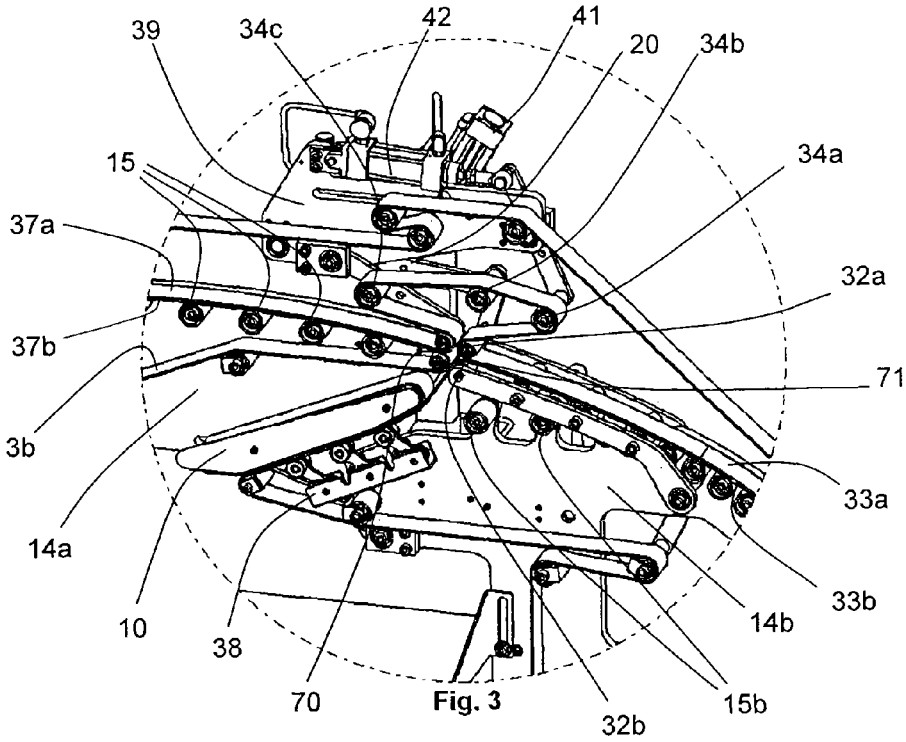
FIG. 3 is a detailed view of the sampling station in a first position.
Figure 4:
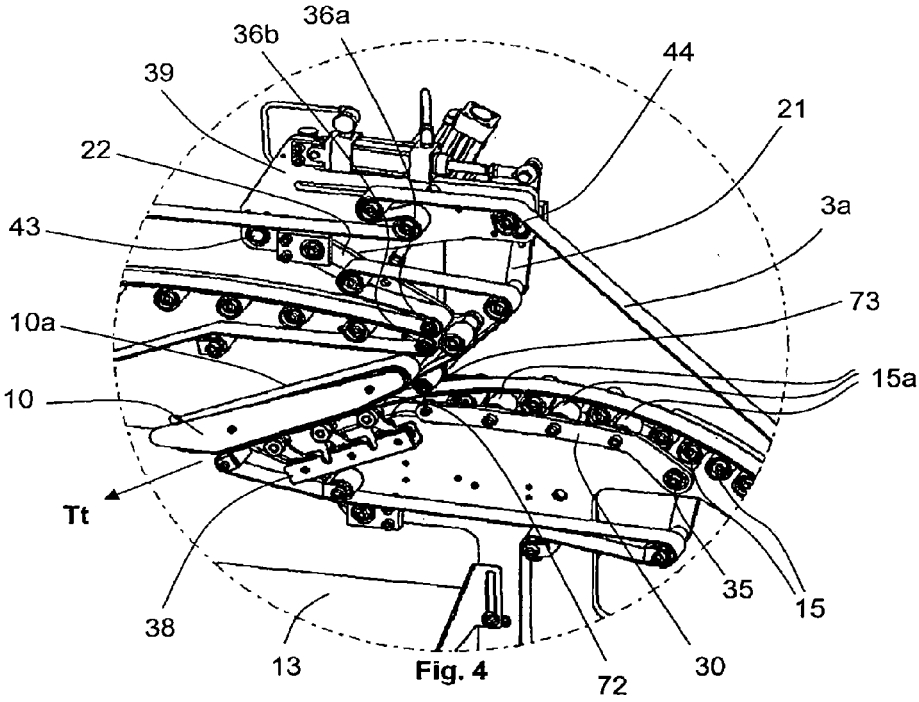
FIG. 4 is a detailed view of the sampling station in a second position.

As can be seen better in FIGS. 3 and 4, the first box conveyor 3 comprises a single upper conveyor 3*a* cooperating with a single lower conveyor 3*b*, the single upper conveyor 3*a* following an approximately curvilinear lower path corresponding to an upper path of the single lower conveyor 3*b* and coinciding with the forwarding path Ta. Support rollers 15, 15*b* are fitted on the vertical support plate 2 along the path Ta in order to guide and support the belts of the first box conveyor 3. The belt of the upper conveyor 3*a* is then sent back along an upper return path while being guided by rollers 16 where it passes via various tensioning devices and a drive shaft before returning to its lower path.

The second box conveyor 10 also comprises a single upper conveyor 10*a* cooperating with an intermediate part of the single lower conveyor 3*b*, the upper conveyor 10*a* following an approximately rectilinear lower path in a downwardly oblique plane at an angle to the horizontal plane, corresponding to an intermediate path of the lower conveyor 3*b* coinciding with the transfer path Tt. Preferably, the angle is between 20° and 30° , for example 25°. Along the transfer path Tt, the belts of the second box conveyor 10 pass between a ramp 38 of support rollers and a ramp of pressure rollers (not shown) fitted respectively at the rear 14*b* and at the front 14*a* of the vertical support plate 2. Thus, the forwarding path Ta and the transfer path Tt are in the same vertical plane. Moreover, it will be noted that the forwarding path Ta defines an essentially convex surface such that the transfer path Tt is located inside this convex surface.

At the sampling station C, the first box conveyor 3 is divided into two different parts: a rear part 33*a*, 33*b* fitted on the rear 14*a* of the vertical support plate and a front part 37*a*, 37*b* fitted on the front 14*b* of the vertical support plate. The rear part 33*a*, 33*b* of the first box conveyor 3 terminates in a pair of front-end rollers 32*a*, 32*b* and the front part 37*a*, 37*b* commences with a pair of rear-end rollers 36*a*, 36*b*. Advantageously, said pair of rear-end rollers 36*a*, 36*b* is located behind said second box conveyor 10, i.e. a box deflected toward the second box conveyor 10 passes beneath the pair of rear-end rollers 36*a*, 36*b*.

In FIG. 3, the sampling station is shown in a first position, where the lower path of the belt of the upper conveyor 3*a* describes an upwardly directed upper loop located above the second box conveyor 10 while being successively guided by a front-end roller 32*a* of the rear part 33*a* of the upper conveyor, by three upper rollers 34*a*, 34*b* and 34*c*, and then sent back by a rear-end roller 36*a* of the front part 37*a* of the upper conveyor. This deflection loop is approximately T-shaped, i.e. the belt of the upper conveyor is wound over the front part of the periphery of the roller 32*a* before being sent back by the roller 34*a* located behind the roller 32*a* toward the roller 34*c* located in front of the roller 36*a*, the roller 34*b* supporting the belt between the rollers 34*a* and 34*c*. The belt is then wound over a rear part of the periphery of the roller 36*a*. The support rollers 15 of the forwarding path Ta are fitted on the vertical support plate in two parts 14*a* and 14*b*. The ramp 38 of support rollers and the ramp of pressure rollers for the transfer path Tt are fitted on the front vertical support plate 14*a*. By contrast, the front-end roller 32*a* of the rear part and the upper roller 34*b* are both fitted on a upper lever 20 controlled by the rod of a cylinder 41, the upper roller 34*a* is fitted on an intermediate lever 21 controlled by the rod of a cylinder 42, while the rear-end roller 36*a* of the front part and the upper roller 34*c* are both fitted on a lever 22. The three levers 20, 21 and 22 and the two cylinders 41 and 42 are all fitted on a bracket 39 secured to the vertical support plate, the bracket 39 being generally T-shaped. The horizontal part of the bracket 39 forms a plate for fastening the levers 20, 21, 22 and the cylinders 41 and 42, while the vertical part of the bracket 39 forms a bridge connecting the rear 14*b* and the front 14*a* of the vertical support plate.

In FIG. 4, the sampling station is shown in a second position, where the lower path of the belt of the upper conveyor 3*a* also describes an upwardly directed upper loop, but a part thereof is located at the same level as the second box conveyor 10, while being successively guided by the front-end roller 32*a* of the rear part 33*a* of the upper conveyor, the roller 34*b*, the rollers 34*a* and 34*c*, and then sent back by the rear-end roller 36*a* of the front part 37*a* of the upper conveyor. The deflection loop has in this case generally a reverse C shape (like a C seen in a mirror), having a large opening, followed by a C shape having a smaller opening, i.e. the belt of the upper conveyor is wound over the front part of the periphery of the roller 32*a* before being sent back by the roller 34*a* located behind the roller 32*a* toward the roller 34*c* located in front of the roller 36*a*, the roller 34*b* in this case bearing against the belt between the rollers 32*a* and 34*a*; the belt is then wound over the rear part of the periphery of the roller 36*a*.

The front part 37*a*, 37*b* of the first box conveyor 3 is fitted fixedly on the front vertical support plate 14*a* such that the lower path of the upper conveyor 3*a* and the upper path of the lower conveyor 3*b* do not change in this front part 37*a*, 37*b*, irrespective of the position of the sampling station C. By contrast, the rear part 33*a*, 33*b* of the first box conveyor 3 is fitted movably on the rear vertical support plate 14*b*, so as to be able to modify the lower path of the upper conveyor 3*a* and the upper path of the lower conveyor 3*b* as a function of the position of the sampling station. Specifically, when the sampling station C is in the first position illustrated in FIG. 3, the belts of the upper conveyor 3*a* and of the lower conveyor 3*b* bear against support rollers 15*a* of a lower lever 30 also carrying the front-end roller 32*b* of the rear part of the lower conveyor. The lower lever 30 is thus in a high position such that the rear part 33*b* is aligned with the front part 37*b* of the lower conveyor 3*b*, whereas the front-end roller 32*a* of the rear part of the upper conveyor carried by the upper lever is in a position such that the rear part 33*a* is aligned with the front part 37*a* of the upper conveyor 3*a*. The lower lever 30 is fitted so as to pivot about a shaft 35 supported by a bearing of the rear vertical support plate 14*b*, the free end of the lever 30 carries the front-end roller 32*b*. The actuating rod of a lower cylinder (not shown) is secured to the lever 30, approximately in the middle of the latter, between the shaft 35 and the front-end roller 32*b*, the lower cylinder being fitted on the rear vertical support plate 14*b*. In this position, the point 71 where the belts of the rear part 33*a*, 33*b* of the first box conveyor diverge is located a short distance from the point 70 where the belts of the front part 37*a*, 37*b* of the first box conveyor converge. This distance is less than the minimum length of the boxes intended to be processed by the filling device according to the invention, thus making it possible to convey the boxes along the forwarding path Ta without any driving interruptions. The point of divergence 71 corresponds to the last point of contact between the belts after they pass between the pair of front-end rollers 32*a*, 32*b*, whereas the point of convergence 70 corresponds to the first point of contact between the belts before they pass between the pair of rear-end rollers 36*a*, 36*b*.

When the sampling station C is in the second position illustrated in FIG. 4, the belts of the upper conveyor 3*a* and of the lower conveyor 3*b* bear against support rollers 15*b* of the rear vertical support plate 14*b*. The lower lever 30 is then in a low position such that the rear part 33*b* of the lower conveyor 3*b* is aligned with the intermediate part of the lower conveyor 3*b* cooperating with the single upper conveyor 10*a* of the second box conveyor 10, whereas the front-end roller 32*a* is in a position such that the rear part 33*a* of the upper conveyor 3*a* is aligned with the lower part of the single upper conveyor 10*a*. By virtue of these arrangements, the second box conveyor 10 is in perfect alignment with the rear part 33*a*, 33*b* of the first box conveyor 3. In this position, the rollers 15*a* of the lower lever 30 are retracted under the rollers 15*b* of the rear vertical support plate while passing between the latter, and the point 72 where the belts of the second box conveyor 10 converge is located a short distance from the point 73 where the belts of the rear part 33*a*, 33*b* of the first box conveyor diverge. The point of convergence 72 corresponds to the first point of contact between the belts before they pass between the ramp 38 of support rollers and the ramp of pressure rollers, whereas the point of divergence 73 corresponds to the last point of contact between the belts after they pass between the pair of rear-end rollers 32*a*, 32*b*.

In order to pass from one position to the other, the sampling station C is provided with deflection means in the rear part 33*a*, 33*b* of the first box conveyor 3 and comprising the lower lever 30, which is controlled by the lower cylinder, the upper lever 20, which is controlled by the cylinder 41, and the intermediate lever 21, which is controlled by the cylinder 42. Preferably, the cylinders are controlled in a synchronized manner.

Therefore, in order to pass from the second position to the first position, the rod of the lower cylinder extends, and in doing so pivots the lower lever 30 clockwise about its shaft 35. The lower lever 30 pivots until the front-end roller 32*b*, which is initially located in line with the ramp 38 of support rollers of the second conveyor 10, is finally in line with the rear-end roller 36*b*. Simultaneously, the rod of the cylinder 41 retracts, and in doing so pivots the upper lever 20 counterclockwise about a shaft 43 supported by a first bearing provided on the plate for fastening the bracket 39. As illustrated in FIG. 3, the upper lever 20 is generally L-shaped, i.e. it has a first approximately rectilinear part adjacent a second likewise rectilinear part, such that the first, longer part forms an angle of approximately 90° with the second, shorter part. The shaft 43 is located on the longest part of the upper lever 20 opposite the adjacent part, whereas the front-end roller 32*a* and the upper roller 34*b* are located on the shortest part of the upper lever, opposite from the adjacent part and in the adjacent part, respectively. The rod of the cylinder 41 is secured to the upper lever 20 approximately in the middle of the longer part, between the pin 43 and the upper roller 34*b*. The upper lever 20 pivots until the front-end roller 32*a*, which is initially located in line with the ramp of pressure rollers of the second conveyor 10, is finally in line with the rear-end roller 36*a*. At the same time, the upper roller 34*b* passes from a first bearing position into a second support position of the deflection loop. Simultaneously, the rod of the cylinder 42 retracts, and in doing so pivots the intermediate lever 21 counterclockwise about a shaft 44 supported by a second bearing provided on the plate for fastening the bracket 39. As illustrated in FIG. 3, the intermediate lever 21 is generally I-shaped, one end of which is secured to the rod of the cylinder and the other end of which holds the upper roller 34*a*, the shaft 44 being located between the two ends. The intermediate lever 21 pivots until the upper roller 34*a* passes from a first position to a second position supporting the deflection loop, the lever 21 in this case acting as a belt tensioner.

Conversely, in order to pass from the first position to the second position, all that is necessary is to repeat the description given in the preceding paragraph, replacing "extends" with "retracts", "clockwise" with "counterclockwise", "initially located" with "finally located", "first position" with "second position", and vice versa.

In a preferred operating mode of the filling device according to the invention, the operator programs into a control panel 50 (see FIG. 2) the desired number of folded boxes per sample $N_{b/e}$ and the desired number of samples per container $N_{e/r}$. In a first step, for example at the start of production, the sampling station C is in the second position, $N_{b/e}$ folded boxes leave the stream feeder A and are forwarded by the first conveyor 3. Once they have arrived in the sampling station C, the $N_{b/e}$ boxes are deflected toward the second conveyor 10 in order to be transferred to the retrieval station D. In a second step, the sampling station C is in the first position so as to send the next boxes to the filling station B. The first and second steps are repeated $N_{e/r}$ times per container.

It will be noted that the distance to be left between the $N_{b/e}$ first boxes and the next boxes depends on the reaction time of the moving parts of the sampling station C. Because the only parts that move are the levers 20, 21 and 30 with their respective cylinder rods, this assembly has a low mass and thus low inertia, enabling this reaction time to be reduced as much as possible.

Advantageously, during production start-up, the invention allows all the boxes to be directed to the retrieval station D, thus avoiding the need for the operator to intervene manually in the filling station B.

It should be noted that the length of the loop formed by the belt of the upper conveyor 3*a* is substantially unchanged between the first position and the second position of the sampling station C, such that it is unnecessary to provide an additional means for adjusting the length of travel of this belt. Specifically, this loop also constitutes a "buffer zone" allowing the lengthening of the belt of the upper conveyor to be absorbed without this lengthening having repercussions downstream in the front part of the upper conveyor.

The invention claimed is:

1. A device for filling a container with collapsible boxes the device comprising a web-forming station, a filling station, a sampling station, and a retrieval station;

a first box conveyor for conveying boxes exiting a folder-gluer to the web-forming station and for forwarding the boxes-from the web-forming station to the filling station along a forwarding path;

a second box conveyor for conveying boxes forwarded by the first box conveyor and for transferring the boxes from the sampling station to the retrieval station along a transfer path; wherein the forwarding path defines an essentially convex surface and the transfer path is located inside the concavity of the convex surface; and the first box conveyor is divided into two parts in the sampling station comprising: a rear part that terminates in a pair of front-end rollers and a front part that commences with a pair of rear-end rollers.

2. The filling device according to claim 1, wherein the first box conveyor comprises a single upper conveyor cooperating with single lower conveyor.

3. The filling device according to claim 1 wherein part of the forwarding path is located above a horizontal plane passing through a median axis of the folder-gluer.

4. The filling device according to claim 1, wherein the forwarding path and the transfer path are located in the same vertical plane, the forwarding path being approximately curvilinear and the transfer path being approximately rectilinear.

5. The filling device according to claim 1, further comprising a frame on which the first box conveyor is mounted, a base having casters and brakes on which the frame is mounted, the base permitting the filling device to be positioned at an exit of the folder-gluer.

6. The filling device according to claim 5, further comprising a belt conveyor supported on the base and extending perpendicular to a median axis of the folder gluer.

7. The filling device according to claim 1, wherein the pair of rear-end rollers is located behind the second box conveyor.

8. The filling device according to claim 1, wherein the sampling station comprises a deflector having a first position, at which the deflector allows the rear part to be aligned with the front part and a second position, at which the deflector allows the rear part to be aligned with the second box conveyor.

* * * * *